US009245728B2

(12) United States Patent
Brown et al.

(10) Patent No.: US 9,245,728 B2
(45) Date of Patent: Jan. 26, 2016

(54) MASS SPECTROMETER WITH BEAM EXPANDER

(71) Applicant: Micromass UK Limited, Wilmslow (GB)

(72) Inventors: Jeffery Mark Brown, Hyde (GB); Anthony James Gilbert, Peak (GB); John Brian Hoyes, Stockport (GB); David J. Langridge, Stockport (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/730,551

(22) Filed: Jun. 4, 2015

(65) Prior Publication Data

US 2015/0270114 A1 Sep. 24, 2015

Related U.S. Application Data

(63) Continuation of application No. 14/456,194, filed on Aug. 11, 2014, now Pat. No. 9,053,918, which is a (Continued)

(30) Foreign Application Priority Data

Jun. 8, 2010 (GB) ..... 1009596.6
Jun. 18, 2010 (GB) ..... 1010300.0

(51) Int. Cl.
*H01J 49/40* (2006.01)
*H01J 49/00* (2006.01)
*H01J 49/06* (2006.01)

(52) U.S. Cl.
CPC ..... *H01J 49/401* (2013.01); *H01J 49/0031* (2013.01); *H01J 49/062* (2013.01); *H01J 49/405* (2013.01)

(58) Field of Classification Search
USPC ..... 250/287, 290, 281, 282, 396 R
See application file for complete search history.

(56) References Cited

U.S. PATENT DOCUMENTS 5,712,479 A 1/1998 Reilly et al.
5,869,829 A 2/1999 Dresch (Continued)

FOREIGN PATENT DOCUMENTS

EP 1274117 1/2003
JP 2000/036286 2/2000

(Continued)

OTHER PUBLICATIONS

Dodonov et al., "*High-Resolution Electrospray Ionization Orthogonal-Injection Time-of-Flight Mass Spectrometer*", European Journal of Mass Spectrometry, vol. 6, No. 6, pp. 481-490, 2000.

(Continued)

*Primary Examiner* — Kiet T Nguyen
(74) *Attorney, Agent, or Firm* — Diederiks & Whitelaw, PLC

(57) ABSTRACT

A mass spectrometer is disclosed comprising a RF confinement device, a beam expander and a Time of Flight mass analyzer. The beam expander is arranged to expand an ion beam emerging from the RF confinement device so that the ion beam is expanded to a diameter of at least 3 mm in the orthogonal acceleration extraction region of the Time of Flight mass analyzer.

17 Claims, 14 Drawing Sheets

Related U.S. Application Data continuation of application No. 13/702,931, filed as application No. PCT/GB2011/051068 on Jun. 7, 2011, now Pat. No. 8,895,920.

(60) Provisional application No. 61/359,562, filed on Jun. 29, 2010, provisional application No. 61/354,746, filed on Jun. 15, 2010.

(56) References Cited

U.S. PATENT DOCUMENTS

| | | | |
|---|---|---|---|
| 5,998,215 | A | 12/1999 | Prather et al. |
| 6,326,615 | B1 | 12/2001 | Syage et al. |
| 6,580,070 | B2 | 6/2003 | Cornish |
| 6,627,877 | B1 | 9/2003 | Davis et al. |
| 6,707,037 | B2 | 3/2004 | Whitehouse |
| 6,835,928 | B2 | 12/2004 | Bateman |
| 7,019,285 | B2 | 3/2006 | Dresch et al. |
| 7,038,197 | B2 | 5/2006 | Bateman et al. |
| 7,161,146 | B2 | 1/2007 | Doroshenko et al. |
| 7,170,052 | B2 | 1/2007 | Furutani et al. |
| 7,326,925 | B2 | 2/2008 | Verentchikov et al. |
| 7,385,187 | B2 | 6/2008 | Verentchikov |
| 7,482,582 | B2 | 1/2009 | Raznikov et al. |
| 7,547,878 | B2 | 6/2009 | Schultz et al. |
| 7,649,170 | B2 | 1/2010 | Wang et al. |
| 7,772,547 | B2 | 8/2010 | Verentchikov |
| 7,786,435 | B2 | 8/2010 | Whitehouse et al. |
| 7,897,916 | B2 | 3/2011 | Sudakov et al. |
| 8,164,052 | B2 | 4/2012 | Green et al. |
| 8,309,913 | B2 | 11/2012 | Wang et al. |
| 8,648,294 | B2 | 2/2014 | Prather et al. |
| 2007/0176090 | A1* | 8/2007 | Verentchikov ..... H01J 49/406 250/287 |
| 2010/0072362 | A1 | 3/2010 | Giles et al. |
| 2011/0168880 | A1 | 7/2011 | Ristroph et al. |

FOREIGN PATENT DOCUMENTS

| | | |
|---|---|---|
| JP | 2003/346706 | 12/2003 |
| WO | 03096375 | 11/2003 |

OTHER PUBLICATIONS

Wiley et al., "*Time-of-Flight Mass Spectrometer with Improved Resolution*", Review of Scientific Instruments, vol. 26, pp. 1150, 1955.

* cited by examiner

Area 1 = Area 2 = Area N

| Parameter | Value |
|---|---|
| Lp | 40mm |
| L12 | 70mm |
| L23 | 600mm |
| Vp | 2000V |
| $V_{TOF}$ | ~8000V |

MASS SPECTROMETER WITH BEAM EXPANDER

CROSS REFERENCE TO RELATED APPLICATIONS

This application represents a continuation application of Ser. No. 14/456,194 entitled "Mass Spectrometer With Beam Expander" filed Aug. 11, 2014, which is a continuation application Ser. No. 13/702,931 entitled "Mass Spectrometer With Beam Expander" filed Dec. 7, 2012, now U.S. Pat. No. 8,895,920, which represents a National Stage application of PCT/GB2011/051068 entitled "Mass Spectrometer With Beam Expander" filed Jun. 7, 2011 which claims priority from and the benefit of United Kingdom Patent Application No. 1009596.6 filed on 8 Jun. 2010, U.S. Provisional Patent Application Ser. No. 61/354,746 filed on 15 Jun. 2010, United Kingdom Patent Application No. 1010300.0 filed on 18 Jun. 2010 and U.S. Provisional Patent Application Ser. No. 61/359,562 filed on 29 Jun. 2010. The entire contents of these applications are incorporated herein by reference.

BACKGROUND TO THE INVENTION

The present invention relates to a mass spectrometer and a method of mass spectrometry. Two stage extraction Time of Flight mass spectrometers are well known. The basic equations that describe two stage extraction Time of Flight mass spectrometers were first set out by Wiley and McLaren (W. C. Wiley and I. H. McLaren "Time-of-Flight Mass Spectrometer with Improved Resolution", Review of Scientific Instruments 26, 1150 (1955)). The principles apply equally to continuous axial extraction Time of Flight mass analysers, orthogonal acceleration Time of Flight mass analysers and time lag focussing instruments. FIG. 1 illustrates the principle of spatial (or space) focussing whereby ions 1 with an initial spatial distribution are present in an orthogonal acceleration extraction region located between a pusher electrode 2 and a first extraction grid electrode 3. The ions in the orthogonal acceleration extraction region are orthogonally accelerated through the first grid electrode 3 and then pass through a second grid electrode 4. The ions then pass through a field free or drift region and are brought to a focus at a plane 5 which corresponds with the plane at which an ion detector is positioned. The region between the pusher electrode 2 and the first grid electrode 3 forms a first stage extraction region and the region between the first grid electrode 3 and the second grid electrode 4 forms a second stage extraction region. The two stage extraction regions enable the instrumental resolution to be improved. The plane 5 of the ion detector is also known as the plane of second order spatial focus.

An ion beam with initial energy ΔVo and with no initial position deviation has a time of flight in the first acceleration stage (i.e. the first stage extraction region which is also referred to as the pusher region) given by:

$$t = \frac{1}{a}\sqrt{\frac{2q}{m}} \cdot [(Vp \pm \Delta Vo)^{1/2} \pm \Delta Vo^{1/2}] \tag{1}$$

wherein m is the mass of the ion, q is the charge, a is the acceleration and Vp is the potential applied to the pusher electrode 2 relative to the potential of the first grid electrode 3.

The initial velocity vo is related to the initial energy ΔVo by the relation:

$$vo = \sqrt{\frac{2 \cdot \Delta Vo}{m}} \tag{2}$$

The second term in the square brackets of Eqn. 1 is referred to as the "turnaround time" which is a major limiting aberration in the design of Time of Flight mass analysers. The concept of turnaround time will now be discussed in more detail with reference to FIGS. 2A and 2B.

Ions that start at the same position within the orthogonal acceleration extraction region but which possess equal and opposite velocities will have identical energies in the flight tube given by:

$$K \cdot E = qVacc + \frac{1}{2}mv^2 \tag{3}$$

However, ions having equal and opposite initial velocities will be separated by the turnaround time Δt. The turnaround time is relatively long if a relatively shallow or low acceleration field is applied (see FIG. 2A). The turnaround time is relatively short if a relatively steep or high acceleration field is applied (see FIG. 2B). It is apparent from comparing FIG. 2B with FIG. 2A that Δt2<Δt1.

Turnaround time is often the major limiting aberration in designing a Time of Flight mass spectrometer and instrument designers go to great lengths to attempt to minimise this effect which results in a reduction in the overall resolution of the mass analyser.

A known approach to the problem of the aberration caused by the turnaround time is to accelerate the ions as forcefully as possible i.e. the acceleration term a in Eqn. 1 is made as large as possible by maximising the electric field. As a result the ratio Vp/Lp is maximised. Practically, this is achieved by making the pusher voltage Vp as high as possible and keeping the width Lp of the orthogonal acceleration extraction region as short as possible. In a known mass spectrometer the distance between the pusher electrode 2 and the first grid electrode 3 is <10 mm.

However, the known approach has a practical limit for a two stage extraction Time of Flight mass analyser since Wiley McLaren type spatial focussing necessitates that the Time of Flight mass analyser has a short field free region L3. As shown in FIG. 3, if the field free region L3 is relatively short then the flight times of ions through the field free region L3 will also be correspondingly short. This is highly problematic since it requires very fast, high bandwidth detection systems and hence it is impractical to increase the ratio Vp/Lp beyond a certain limit.

In order to improve the resolution of a Time of Flight mass analyser by adding a reflectron. The addition of a reflectron has the effect of re-imaging the first position of spatial focus at the ion detector as shown in FIG. 4 leading to longer practical flight time instruments which are capable of very high resolution. Reference is made to Dodonov et al., European Journal of Mass Spectrometry Volume 6, Issue 6, pages 481-490 (2000).

However, the addition of a reflectron to a Time of Flight mass spectrometer adds complexity and expense to the overall design of the instrument.

It is desired to provide a Time of Flight mass analyser which has a relatively high mass resolution but which does not necessarily include a reflectron.

SUMMARY OF THE INVENTION

According to an aspect of the present invention there is provided a mass spectrometer comprising:

an RF ion confinement device; and a Time of Flight mass analyser arranged downstream of the RF ion confinement device, the Time of Flight mass analyser comprising an orthogonal acceleration extraction region;

characterised in that:

the mass spectrometer further comprises an ion beam expander being arranged downstream of the RF ion confinement device, the ion beam expander arranged and adapted to expand an ion beam which emerges, in use, from the RF ion confinement device so that the ion beam has a diameter or maximum cross-sectional width>3 mm in the orthogonal acceleration extraction region.

The ion beam expander is preferably arranged and adapted to expand the ion beam which emerges, in use, from the RF ion confinement device so that the ion beam has a diameter or maximum cross-sectional width of x mm in the orthogonal acceleration extraction region, wherein x is selected from the group consisting of: (i) 3-4; (ii) 4-5; (iii) 5-6; (iv) 6-7; (v) 7-8; (vi) 8-9; (vii) 9-10; (viii) 10-11; (ix) 11-12; (x) 12-13; (xi) 13-14; (xii) 14-15; (xiv) 15-16; (xiv) 16-17; (xv) 17-18; (xvi) 18-19; (xvii) 19-20; (xviii) 20-21; (xix) 21-22; (xx) 22-23; (xxi) 23-24; (xxii) 24-25; (xxiii) 25-26; (xxiv) 26-27; (xxv) 27-28; (xxvi) 28-29; (xxvii) 29-30; (xxviii) 30-31; (xxix) 31-32; (xxx) 32-33; (xxxi) 33-34; (xxxii) 34-35; (xxxiv) 35-36; (xxxiv) 36-37; (xxxv) 37-38; (xxxvi) 38-39; (xxxvii) 39-40; and (xxxviii) >40.

The RF ion confinement device preferably comprises an ion guide or ion trap.

The ion beam expander preferably comprises one or more Einzel lenses or other ion-optical devices which can expand an ion beam.

The mass spectrometer preferably comprises a first vacuum chamber, a second vacuum chamber and a differential pumping aperture arranged between the first vacuum chamber and the second vacuum chamber, wherein the RF ion confinement device is located in the first vacuum chamber and the Time of Flight mass analyser is arranged in the second vacuum chamber. Less preferred embodiments are contemplated wherein one or more intermediate vacuum chambers may be arranged between the first and second vacuum chambers.

The ion beam expander preferably comprises a first Einzel lens arranged in the first vacuum chamber and/or a second Einzel lens arranged in the second vacuum chamber. According to a less preferred embodiment either the first and/or the second Einzel lens may be substituted for another ion-optical device which has the effect of operating upon the ion beam.

The Time of Flight mass analyser preferably comprises a pusher electrode and a first grid electrode, wherein the orthogonal acceleration extraction region is arranged between the pusher electrode and the first grid electrode. According to the preferred embodiment in use at least some ions located in the orthogonal acceleration extraction region are orthogonally accelerated into a drift region of the Time of Flight mass analyser.

The distance L between the ion exit of the RF confinement device and the longitudinal mid-point or centre of the orthogonal acceleration extraction region is preferably selected from the group consisting of: (i) >100 mm; (ii) 100-120 mm; (iii) 120-140 mm; (iv) 140-160 mm; (v) 160-180 mm; (vi) 180-200 mm; (vii) 200-220 mm; (viii) 220-240 mm; (ix) 240-260 mm; (x) 260-280 mm; (xi) 280-300 mm; (xii) 300-320 mm; (xiii) 320-340 mm; (xiv) 340-360 mm; (xv) 360-380 mm; (xvi) 380-400 mm; and (xvii) >400 mm.

The Time of Flight mass analyser preferably further comprises a second grid electrode arranged downstream of the first grid electrode. A field free region is preferably arranged downstream of the second grid electrode and upstream of an ion detector.

According to the preferred embodiment the Time of Flight mass analyser is preferably arranged so that ions pass from the first grid electrode to the second grid electrode, through the field free region to the ion detector without being reflected in the opposite direction (by e.g. a reflectron). However, according to a less preferred embodiment the Time of Flight mass analyser may include a reflectron.

The ion beam which emerges, in use, from the RF ion confinement device preferably has a first cross section, a first positional spread and a first velocity spread. The ion beam in the orthogonal acceleration extraction region preferably has a second cross section, a second positional spread and a second velocity spread. According to the preferred embodiment: (i) the second positional spread is preferably greater than the first positional spread; and/or (ii) the second velocity spread at a particular position is preferably less than the first velocity spread at a particular position; and/or (iii) a maximum diameter or maximum cross-sectional width of the first cross section is preferably less than a maximum diameter or maximum cross-sectional width of the second cross section.

The Time of Flight mass analyser may be arranged and adapted to analyse positive (or negative) ions and the mass spectrometer may further comprise a further Time of Flight mass analyser which is arranged and adapted to analyse negative (or positive) ions, wherein the further Time of Flight mass analyser is preferably arranged adjacent to the Time of Flight mass analyser. The two Time of Flight mass analysers are preferably structurally distinct (c.f. one Time of Flight mass analyser operated in two different modes of operation).

According to an aspect of the present invention there is provided a method of mass spectrometry comprising:

providing an RF ion confinement device and a Time of Flight mass analyser arranged downstream of the RF ion confinement device, the Time of Flight mass analyser comprising an orthogonal acceleration extraction region; and expanding an ion beam which emerges from the RF ion confinement device so that the ion beam has a diameter or maximum cross-sectional width>3 mm in the orthogonal acceleration extraction region.

According to an aspect of the present invention there is provided a mass spectrometer comprising a first Time of Flight mass analyser arranged and adapted to analyse positive ions and a second Time of Flight mass analyser arranged and adapted to analyse negative ions, wherein the second Time of Flight mass analyser is arranged adjacent to the first Time of Flight mass analyser. The two Time of Flight mass analysers are structurally distinct from each other.

The mass spectrometer preferably comprises a pusher electrode common to the first and second Time of Flight mass analysers. The first Time of Flight mass analyser preferably further comprises a first grid electrode, a second grid electrode, a drift region and an ion detector. The second Time of Flight mass analyser preferably further comprises a first grid electrode, a second grid electrode, a drift region and an ion detector.

The first and/or second Time of Flight mass analysers are preferably arranged so that ions pass from the first grid electrode to the second grid electrode, through the field free region to the ion detector without being reflected in the opposite direction. However, according to a less preferred embodiment the first and/or second Time of Flight mass analysers may comprise a reflectron.

According to an aspect of the present invention there is provided a method of mass spectrometry comprising:

providing a first Time of Flight mass analyser and a second Time of Flight mass analyser, wherein the second Time of Flight mass analyser is arranged adjacent to the first Time of Flight mass analyser;

analysing positive ions using the first Time of Flight mass analyser; and analysing negative ions using the second Time of Flight mass analyser.

According to an aspect of the present invention there is provided a mass spectrometer comprising:

a Time of Flight mass analyser comprising an orthogonal acceleration extraction region;

wherein the mass spectrometer further comprises an ion beam expander arranged and adapted to expand an ion beam so that the ion beam has a diameter or maximum cross-sectional width>3 mm, >4 mm, >5 mm, >6 mm, >7 mm, >8 mm, >9 mm or >10 mm in the orthogonal acceleration extraction region.

According to an aspect of the present invention there is provided a method of mass spectrometry comprising:

providing a Time of Flight mass analyser comprising an orthogonal acceleration extraction region; and expanding an ion beam so that the ion beam has a diameter or maximum cross-sectional width>3 mm, >4 mm, >5 mm, >6 mm, >7 mm, >8 mm, >9 mm or >10 mm in the orthogonal acceleration extraction region.

According to another aspect of the present invention there is provided a mass spectrometer comprising:

a device arranged upstream of a Time of Flight mass analyser, the device being arranged and adapted to reduce the turnaround time of ions orthogonally accelerated into the Time of Flight mass analyser.

The device preferably comprises an ion beam expander.

According to another aspect of the present invention there is provided a method of mass spectrometry comprising:

reducing the turnaround time of ions prior to orthogonally accelerating the ions into a Time of Flight mass analyser.

The step of reducing the turnaround time preferably comprises using an ion beam expander.

According to another aspect of the present invention there is provided a mass spectrometer comprising:

an ion beam expander arranged upstream of a Time of Flight mass analyser, the ion beam expander being arranged and adapted to expand an ion beam and reduce the turnaround time of ions in the ion beam which are orthogonally accelerated into the Time of Flight mass analyser.

According to another aspect of the present invention there is provided a method of mass spectrometry comprising:

expanding an ion beam upstream of a Time of Flight mass analyser so as to reduce the turnaround time of ions in the ion beam which are orthogonally accelerated into the Time of Flight mass analyser.

According to the preferred embodiment a mass spectrometer is provided comprising a RF ion confinement device, an ion beam expander and a Time of Flight mass analyser. The beam expander preferably comprises one or more lenses which preferably expand an ion beam to such a size that a practical two stage Wiley McLaren Time of Flight mass analyser can be realised without suffering from an excessively large turnaround time aberration. As a result, at least according to the preferred embodiment a high resolution Time of Flight mass analyser can be provided which does not require the provision of a reflectron.

According to an embodiment the mass spectrometer preferably further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source.

The mass spectrometer preferably further comprises one or more continuous or pulsed ion sources.

The mass spectrometer preferably further comprises one or more ion guides.

The mass spectrometer preferably further comprises one or more ion mobility separation devices and/or one or more Field Asymmetric Ion Mobility Spectrometer devices.

The mass spectrometer preferably further comprises one or more ion traps or one or more ion trapping regions.

The mass spectrometer preferably further comprises one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer may comprise one or more energy analysers or electrostatic energy analysers.

The mass spectrometer preferably comprises one or more ion detectors.

The mass spectrometer preferably further comprises one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter.

The mass spectrometer preferably further comprises a device or ion gate for pulsing ions.

The mass spectrometer preferably further comprises a device for converting a substantially continuous ion beam into a pulsed ion beam.

The mass spectrometer may further comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention together with other arrangements given for illustrative purposes only, will now be described, by way of example only and with reference to the accompanying drawings in which.

DETAILED DESCRIPTION OF THE PREFERRED EMBODIMENTS

A preferred embodiment of the present invention will now be described initially by referring back to Eqn. 1. If Eqn. 1 is rewritten in terms of velocity vo then this leads to the relationship for the turnaround time t' such that:

$$t' = \frac{Lp \cdot mv}{qVp} \tag{4}$$

The term mv is the momentum of an ion beam and the width Lp of the pusher region is inherently related linearly to the extent or width of the ion beam in the pusher or extraction region of the Time of Flight mass analyser.

A fundamental theorem in ion optics is "Liouville's theorem" which states that "For a cloud of moving particles, the particle density $\rho(x, p_x, y, p_y, z, p_z)$ in phase space is invariable" (Geometrical Charged-Particle Optics, Harald H. Rose, Springer Series in Optical Sciences 142), wherein $p_x$, $p_y$ and $p_z$ are the momenta of the three Cartesian coordinate directions.

According to Liouville's theorem, a cloud of particles at a time $t_1$ that fills a certain volume in phase space may change its shape at a later time $t_n$ but not the magnitude of its volume. Attempts to reduce this volume by the use of electromagnetic fields is futile although it is of course possible to sample desired regions of phase space by aperturing the beam (rejecting un-focusable ions) before subsequent manipulation. A first order approximation splits Liouville's theorem into three independent space coordinates x, y and z. The ion beam can now be described in terms of three independent phase space areas, the shape of which change as the ion beam progresses through an ion optical system but not the total area itself.

Figure 1:
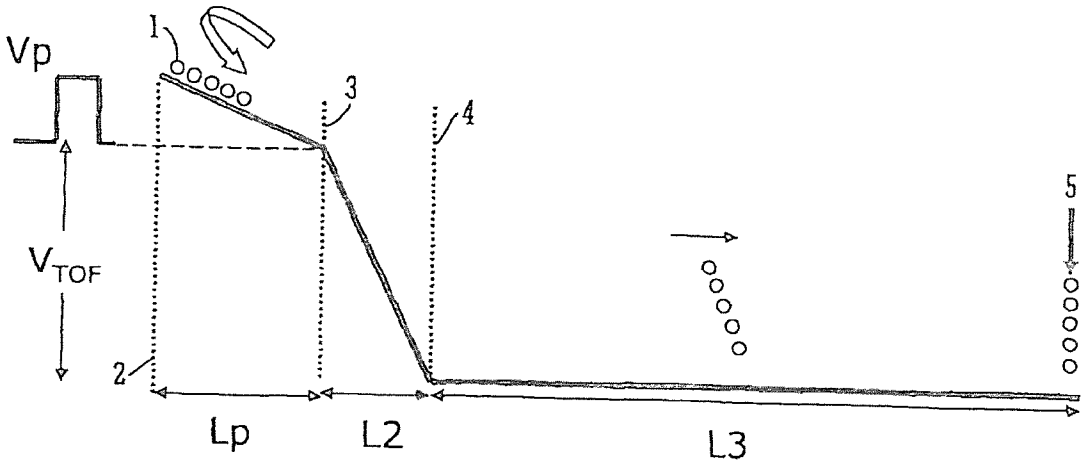
FIG. 1 illustrates the principles of focusing ions using a two-stage (Wiley & McLaren) extraction geometry.
Figure 2B:
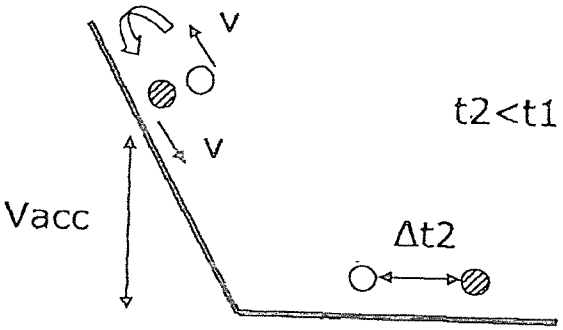
FIG. 2A illustrates the concept of turnaround time in the situation where a relatively shallow voltage gradient is applied across the first extraction region and FIG. 2B illustrates the concept of turnaround time in the situation where a relatively steep voltage gradient is applied across the first extraction region.
Figure 2A:
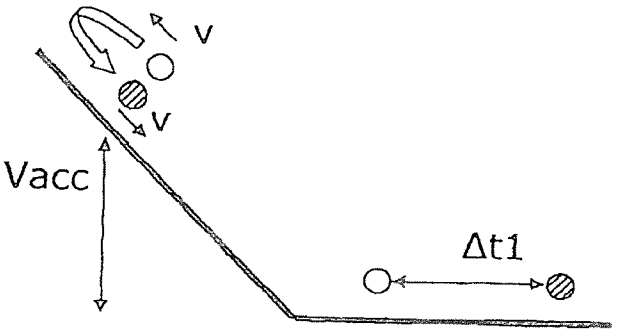
Figure 3:
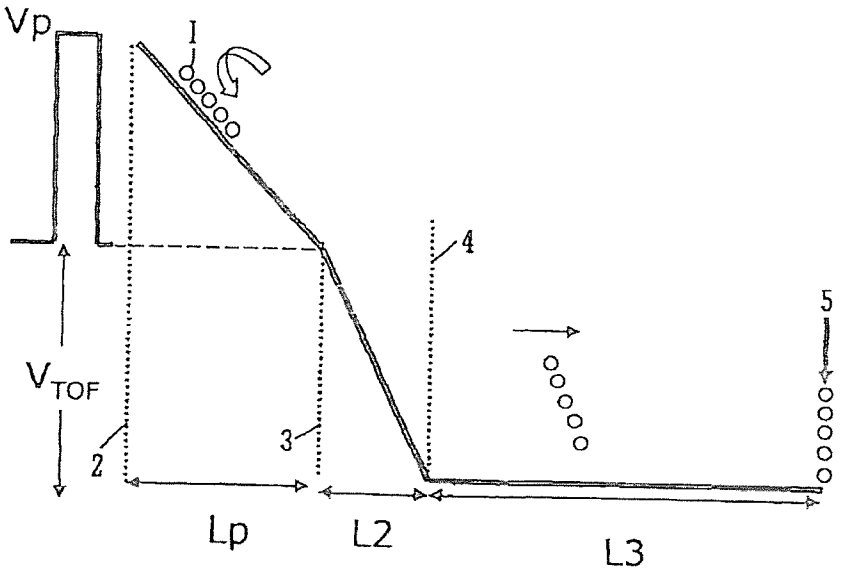
FIG. 3 illustrates how setting a very high initial extraction field in the first stage of a two stage extraction Time of Flight mass analyser necessitates a short field free region.
Figure 4:
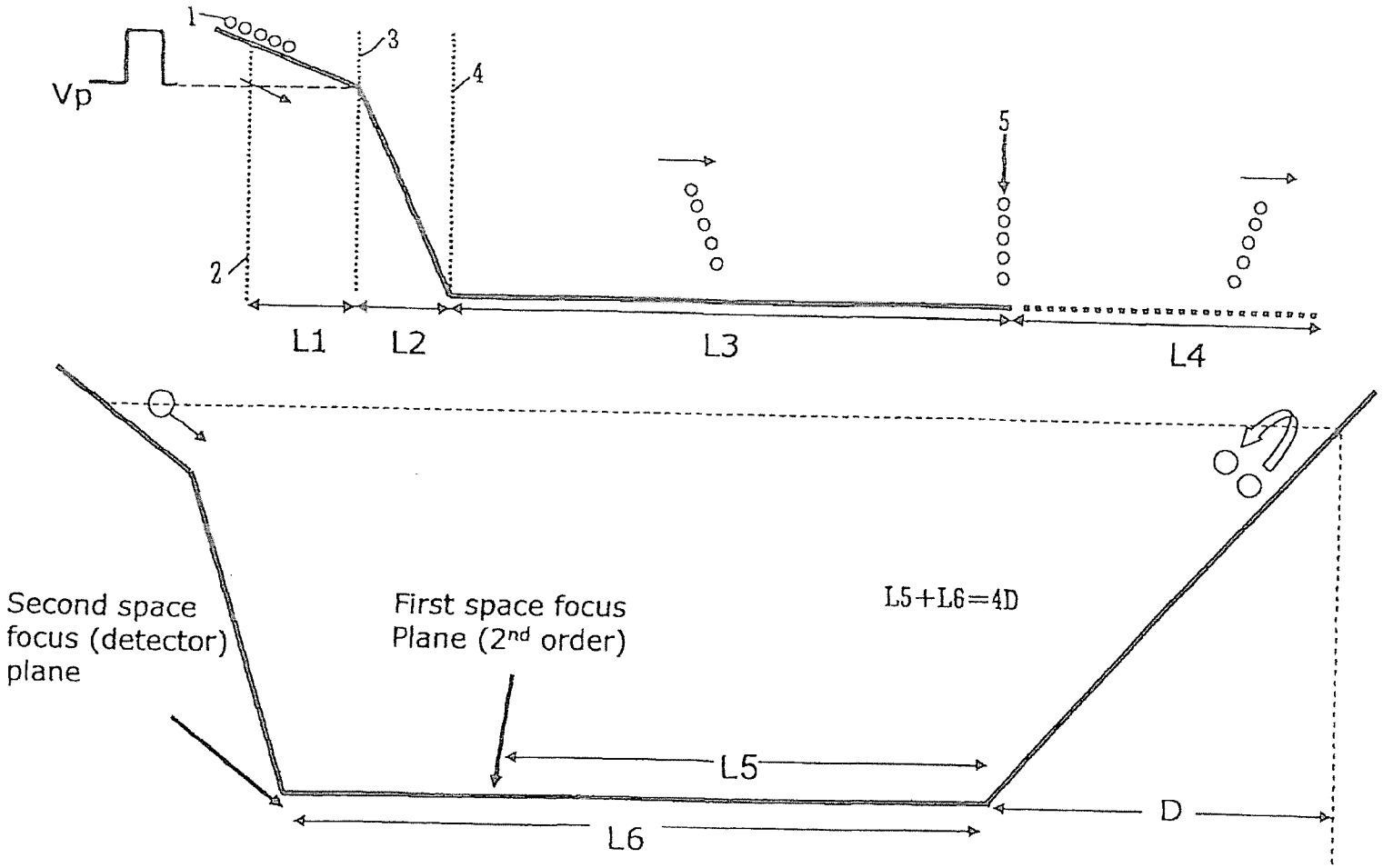
FIG. 4 illustrates how the addition of a reflectron in an orthogonal acceleration Time of Flight mass analyser allows the combination of a relatively high extraction field to be applied together with a relatively long field free flight region.
Figure 5:
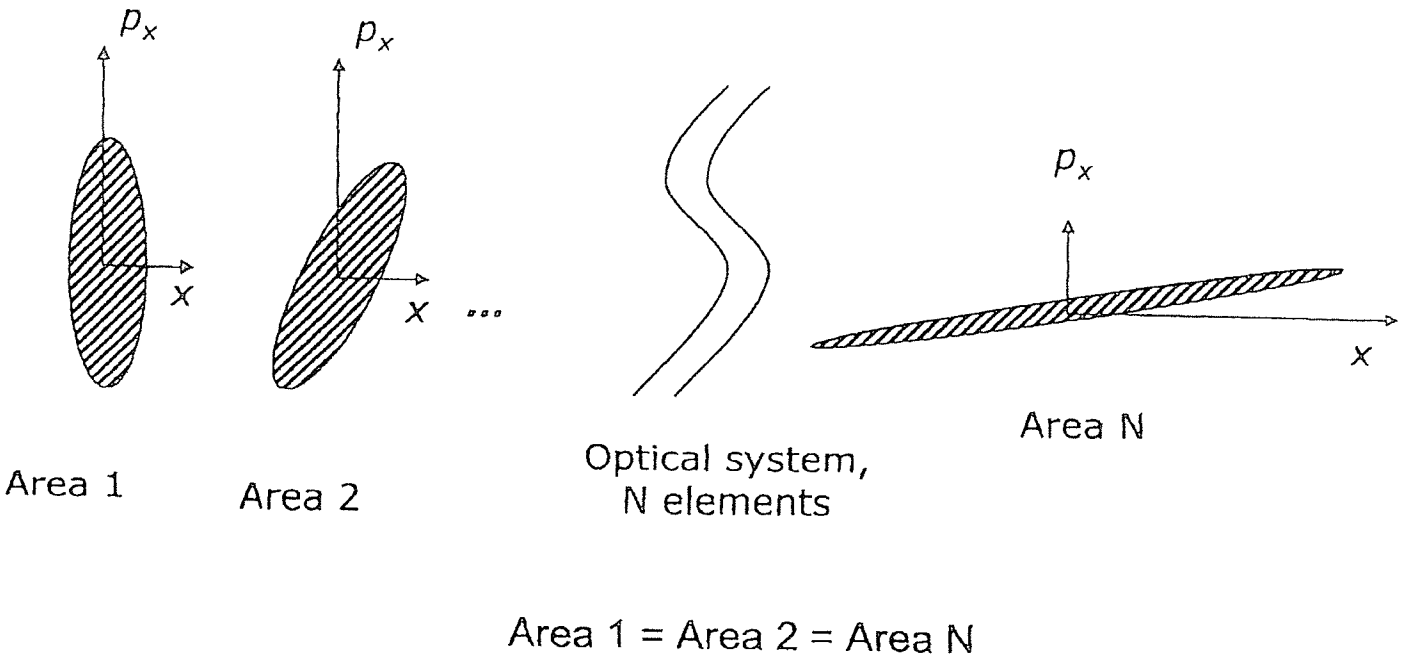
FIG. 5 illustrates Liouville's theorem.

This concept is illustrated in FIG. 5 which shows an optical system comprising N optical elements with each element changing the shape of the phase space but not its area. The preferred embodiment utilises this principle to prepare an ion beam in an optimal manner for analysis by an orthogonal acceleration Time of Flight mass analyser.

As a result of conservation of phase space the $\Delta x\, p_x$ term is constant and so expanding the beam to fill a large gap pusher region will lead to lower velocity spreads. This is because $\Delta x\, p_x$ is proportional to the Lp*mv term in Eqn. 4. With carefully designed transfer optics to give best fill of the pusher region then the turnaround time t' scales as follows:

$$t' \propto \frac{1}{Vp} \quad (5)$$

According to the preferred embodiment an orthogonal acceleration Time of Flight mass analyser is provided which spatially focuses a large positional spread Δx and together with optimised beam expanding transfer optics enables an optimal two stage Wiley McLaren linear Time of Flight mass analyser to be provided which has a significantly reduced aberration due to turnaround time effects. A relatively large pusher gap (i.e. first acceleration stage) leads to a relatively large second acceleration stage and a relatively long field free region. As a result, the Time of Flight mass analyser has relatively long flight times which enables a practical instrument to be constructed. Assuming that the spatial focussing conditions for an expanded ion beam are met, then the turnaround time depends only on the size or amplitude of the pusher pulse Vp applied to the pusher electrode 2 and not on the field Vp/Lp.

The initial conditions of an ion beam arriving in the orthogonal acceleration extraction region of an orthogonal acceleration Time of Flight mass analyser is often defined by an RF ion optical element such as a stacked ring ion guide ("SRIG") in the presence of a buffer gas. Ions in the ion guide will tend to adopt a Maxwellian distribution of velocities upon exit from the RF element due to the thermal motion of gas molecules. The cross section of an ion beam which emerges from an RF ion optical element in a known spectrometer is typically of the order 1-2 mm.

According to the preferred embodiment of the present invention an ion beam expander comprising one, two or more than two Einzel lenses is provided downstream of a RF confinement device or ion guide and is preferably arranged to provide an ion beam expansion ratio of at least ×2, ×3, ×4, ×5, ×6, ×7, ×8, ×9, ×10, ×11, ×12, ×13, ×14, ×15, ×16, ×17, ×18, ×19 or ×20. Therefore, according to an embodiment the ion beam expander preferably has the effect of increasing the cross section of the ion beam arriving in the orthogonal acceleration region of a Time of Flight mass analyser pusher to approx. 5-10 mm, 10-15 mm, 15-20 mm, 20-25 mm or 25-30 mm. According to an embodiment the ion beam is expanded to 20 mm. It will be understood that a 20 mm diameter ion beam in the pusher region of a Time of Flight mass analyser is significantly larger than the case with known commercial Time of Flight mass analysers.

Figure 6:
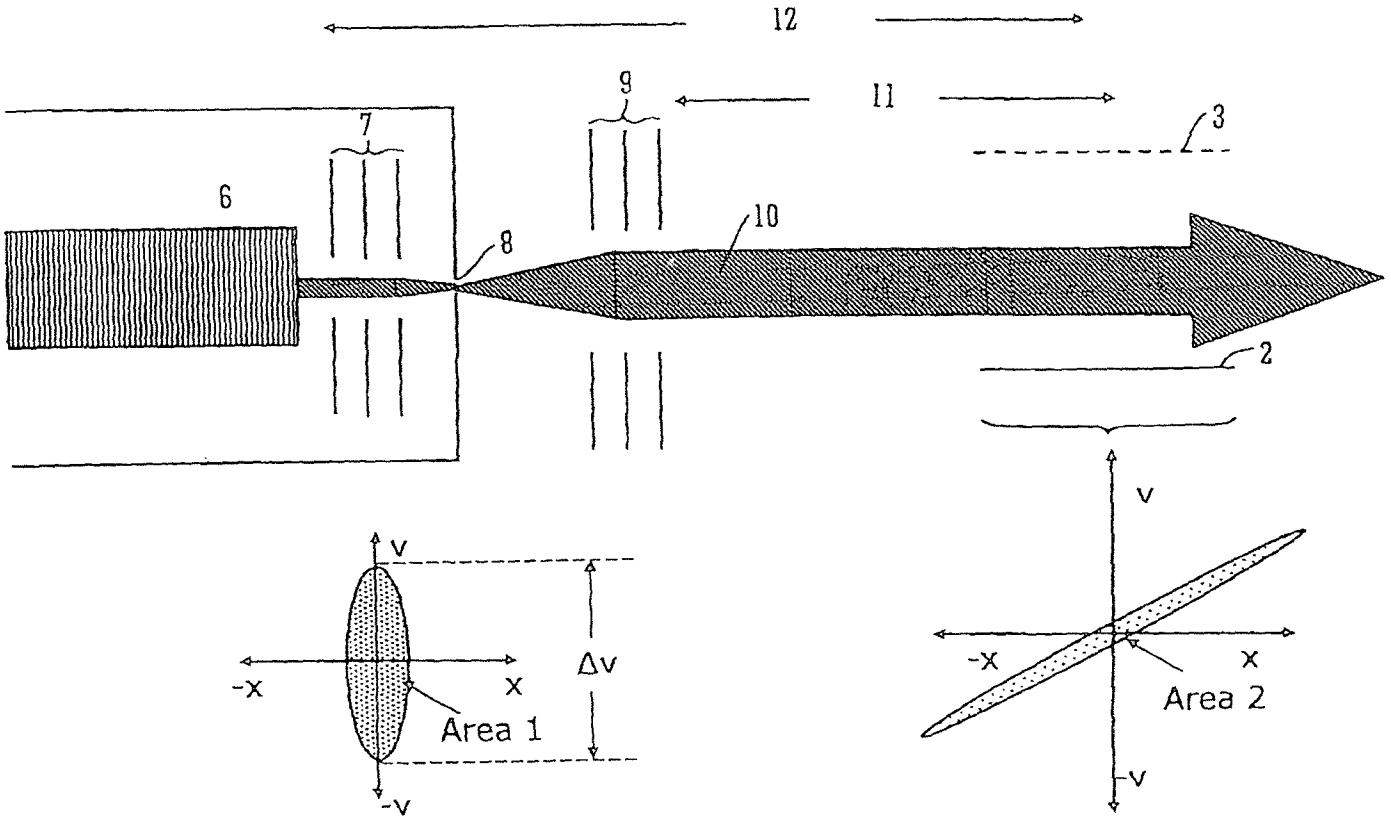
FIG. 6 shows an embodiment of the present invention wherein a beam expander is provided downstream of a stacked ring ion guide ("SRIG") in order to expand the ion beam so that the ion beam has a relatively large cross-section in the orthogonal acceleration extraction region of an orthogonal acceleration Time of Flight mass analyser.

FIG. 6 shows a preferred embodiment of the present invention. A stacked ring ion guide ("SRIG") 6 is provided in a vacuum chamber. A first Einzel lens 7 is provided at the exit of the ion guide 6 and focuses the ion beam which emerges from the ion guide 6 through a differential pumping aperture 8. The ion beam is subsequently collimated by a second Einzel lens 9 in a further vacuum chamber arranged downstream of the vacuum chamber housing the ion guide 6. The (collimated) ion beam 10 is then onwardly transmitted to an orthogonal acceleration extraction region or pusher region of a Time of Flight mass analyser. The orthogonal acceleration extraction region or pusher region is defined as being the region between a pusher electrode 2 (or equivalent) and a first grid electrode 3 (or equivalent).

The ion beam 10 preferably experiences a field free region 11 after passing through (and being collimated by) the second Einzel lens 9. An aperture (not shown) may be provided between the second Einzel lens 9 and the pusher region of the Time of Flight analyser. According to the preferred embodiment the ion beam 10 is not attenuated by the aperture. According to an embodiment the aperture may be approx. 20 mm in diameter. It will be apparent that such a large aperture leading into the pusher region is significantly larger than comparable apertures in known commercial mass spectrometers which are typically 1-2 mm in diameter. The distance 12 between the upstream end of the first Einzel lens 7 (and the exit of the RF confinement device 6) and the centre of the pusher region is according to the preferred embodiment approx. 300 mm. Again, this is significantly longer than known commercial mass spectrometers where this length is typically of the order of 100 mm.

It will be apparent to those skilled in the art from FIG. 6 that according to the preferred embodiment as a result of the beam expander (i.e. Einzel lenses 7,9) as the positional spread increases then the velocity spread at any particular position reduces so that the total overall area of phase space is conserved. FIG. 6 shows that the evolution of phase space leads to an inclined ellipse where there is a good correlation between the position of an ion in the pusher region and its velocity. This is to be expected in view of the relatively long field free region 11 (FFR) from the second lens 9 to the centre of the pusher region. The relatively long field free region allows time for faster ions to move to positions further from the optic axis.

Figure 7A:
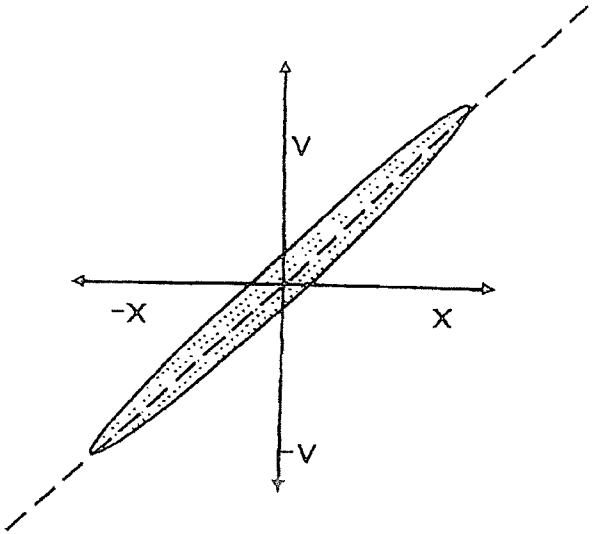
FIG. 7A illustrates the correlation between ion position and velocity as a dashed line and FIG. 7B shows how according to the preferred embodiment any aberration due to the effect shown in FIG. 7A is effectively eliminated.
Figure 7B:
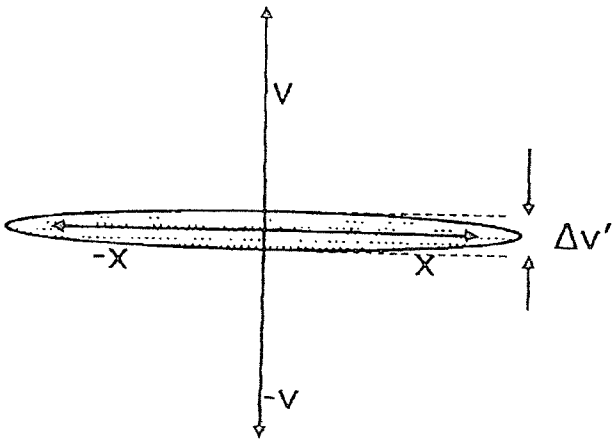

FIG. 7A illustrates the correlation between ion position and velocity as a dashed line. By tuning the Time of Flight voltages any aberration due to this effect can be eliminated thereby effectively flattening the gradient as shown in FIG. 7B. As a result, this leaves only the residual velocity spread Δv' contributing to the turnaround time which itself has been scaled down from the original Δv figure by virtue of the beam expansion and conservation of phase space.

Figure 8:
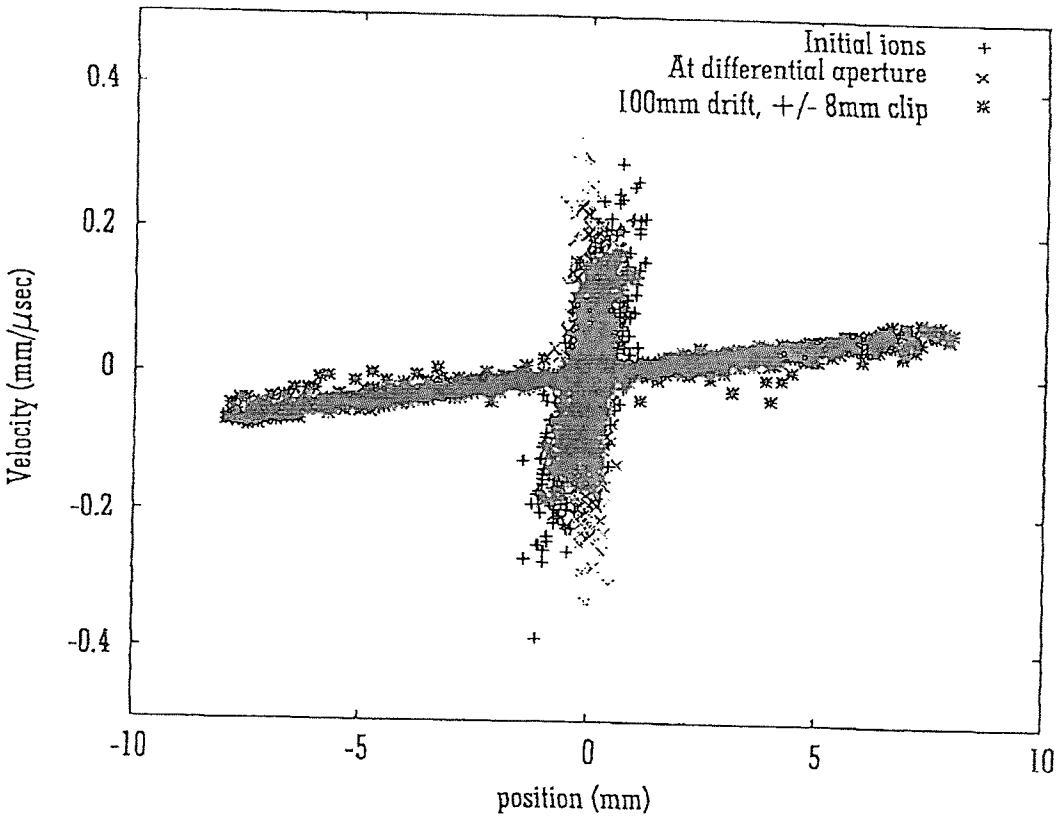
FIG. 8 shows the progression of phase space according to a preferred embodiment of the present invention using a SIMION® simulation.
Figures 9A, 9B:
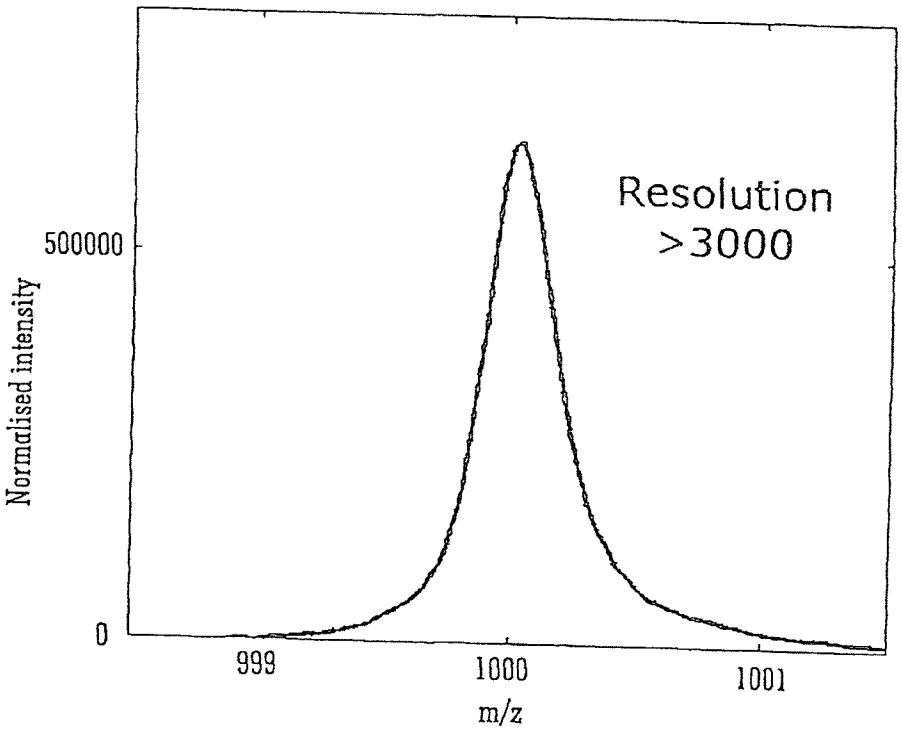
FIG. 9A shows parameters for an orthogonal acceleration Time of Flight mass analyser according to an embodiment of the present invention and FIG. 9B shows the predicted peak shape and resolution of an instrument according to an embodiment of the present invention.

Simulations of the velocity spreads have been performed using SIMION® and an in-house designed hard sphere model. The hard sphere model simulates collisions with residual gas molecules in a stacked ring ion guide ("SRIG"). The progression of the phase space characteristics of the ions through a beam expander according to an embodiment of the present invention is shown in FIG. 8. The ion conditions were then used as input beam parameters for a relatively large pusher two stage orthogonal acceleration Time of Flight mass analyser with parameters as shown in the table shown in FIG. 9A. The simulated resolution (>3000) from such a mass analyser is shown in FIG. 9B.

Figure 10A:
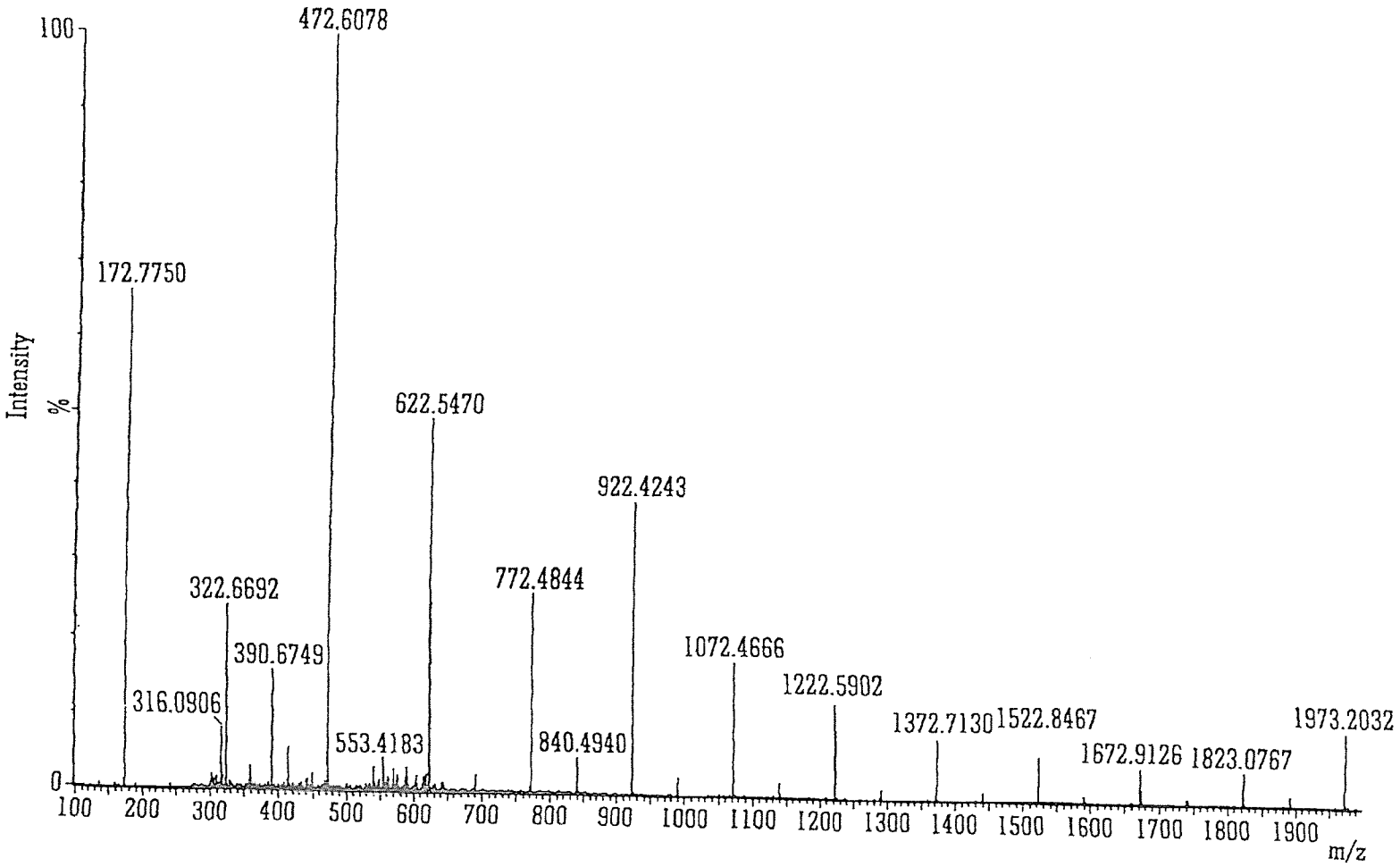
FIG. 10A shows a mass spectrum of sodium iodide obtained using a mass spectrometer according to a preferred embodiment and FIG. 10B highlights individual ion peaks shown in FIG. 10A together with their corresponding resolution.
Figure 10B:
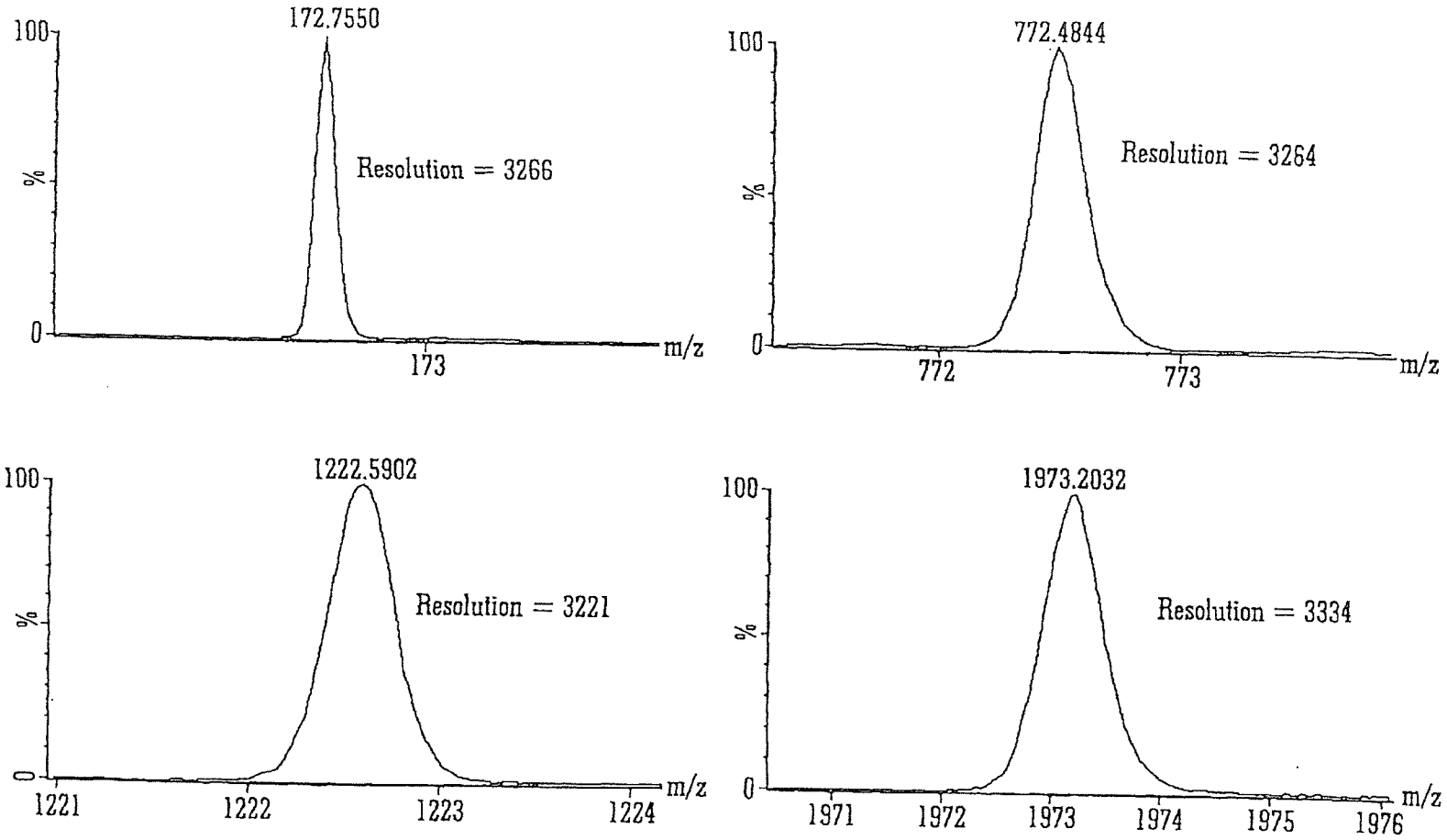

FIG. 10A shows a mass spectrum of sodium iodide obtained according to a preferred embodiment of the present invention. FIG. 10B shows individual ion peaks observed in the mass spectrum shown in FIG. 10A together with the determined resolution. It is apparent that the experimental results are in good accordance with the theoretical model.

It is a common requirement in mass spectrometry to be able to switch ionisation polarity between positive and negative ion modes within fast chromatographic timescales. To achieve quantification in both ion polarity modes in a single chromatographic run, the switching time should be of the order of tens of milliseconds. It is straightforward to switch the ionisation mode of the ion source itself within the millisecond timescale, but switching the orthogonal acceleration Time of Flight mass analyser polarity is problematic due to the strain it places on the power supplies and the ion detector. The power supplies also take a significant time to stabilise after a switch. Such a problem does not exist for quadrupole mass spectrometers as it is relatively easy to switch the relatively low voltages applied to the quadrupole mass analyser. As a result, they have become instruments of choice for fast positive/negative switching applications.

In an orthogonal acceleration Time of Flight mass analyser the flight tube and the ion detector (commonly a micro channel plate) are often held below ground potential typically at many kilovolts (e.g. −8 kV for positive ion detection) and it is this high voltage that is problematic for the power supply to switch rapidly between polarities. The faster the switching time and switching rate, the more power that is required from the power supply. Also, such rapid switching can cause arcs in the instrument which can damage the sensitive ion detector and associated electronics.

Figure 11A:
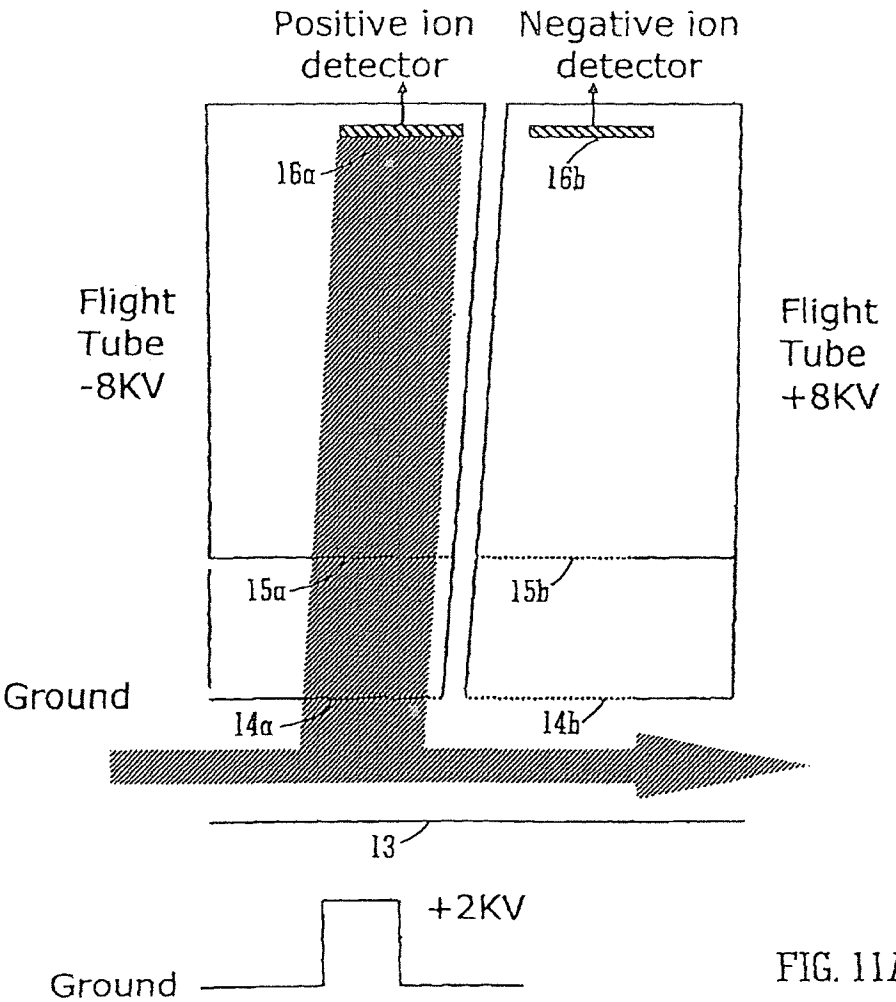
FIG. 11A shows an embodiment of the present invention wherein two adjacent Time of Flight mass analysers are provided for easy positive to negative ionisation mode switching and wherein positive ions are in the process of being detected and FIG. 11B shows a corresponding embodiment wherein negative ions are in the process of being detected.

According to an embodiment of the present invention a mass spectrometer is provided comprising two adjacent orthogonal acceleration Time of Flight mass analysers. Such an arrangement is shown in FIG. 11A (when analysing positive ions) and FIG. 11B (when analysing negative ions). According to the preferred embodiment one of the mass analysers is preferably configured to detect positive ions all the time during an experimental run and the other mass analyser is preferably configured to detect negative ions all the time during an experimental run. The compact arrangement of the two mass analysers negates the need for fast switching of the high voltage flight tube and floated detector supply.

FIG. 11A shows an embodiment wherein ions arrive in the pusher region or orthogonal acceleration extraction region arranged between a pusher electrode 13 and first grid electrodes 14*a*,14*b*. When the instrument is set to detect positive ions then ions are orthogonally accelerated into the first Time of Flight mass analyser comprising a first grid electrode 14*a*, a second grid electrode 15*a*, a field free region and an ion detector 16*a*. The first grid electrode 14*a* is preferably held at ground or 0V and the flight tube is preferably held at −8 kV. A voltage pulse having an amplitude of +2 kV is preferably applied to the pusher electrode 13. The second Time of Flight mass analyser comprises a first grid electrode 14*b*, a second grid electrode 15*b*, a field free region and an ion detector 16*b*. The first grid electrode 14*b* is preferably held at ground or 0V and the flight tube is preferably held at +8 kV. As a result, (positive) ions are preferably only orthogonally accelerated into the first Time of Flight mass analyser and detected by the ion detector 16*a*.

Figure 11B:
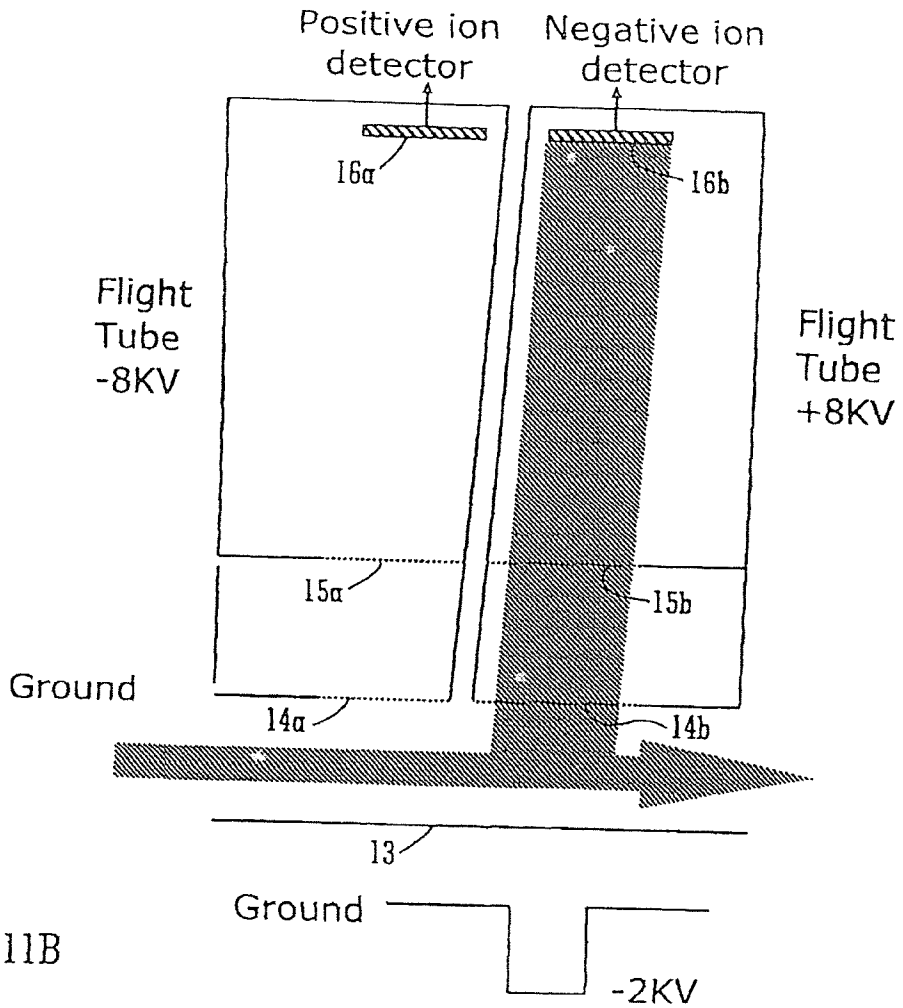

FIG. 11B shows an embodiment wherein ions arrive in the pusher region or orthogonal acceleration extraction region arranged between the pusher electrode 13 and the first grid electrodes 14*a*,14*b*. When the instrument is set to analyse negative ions then ions are orthogonally accelerated into the second Time of Flight mass analyser. The first grid electrode 14*b* is preferably held at ground or 0V and the flight tube is preferably held at +8 kV. A voltage pulse having an amplitude of −2 kV is preferably applied to the pusher electrode 13. As a result, (negative) ions are preferably only orthogonally accelerated into the second Time of Flight mass analyser and detected by the ion detector 16*b*.

According to an embodiment the two orthogonal acceleration Time of Flight mass analysers may share the same extended pusher electrode 13 and the first grid plates or electrodes 14*a*,14*b*. Ions may be directed into one or the other analyser by choosing the polarity of the voltage pulse applied to the pusher pulse or pusher electrode 13.

Figure 12:
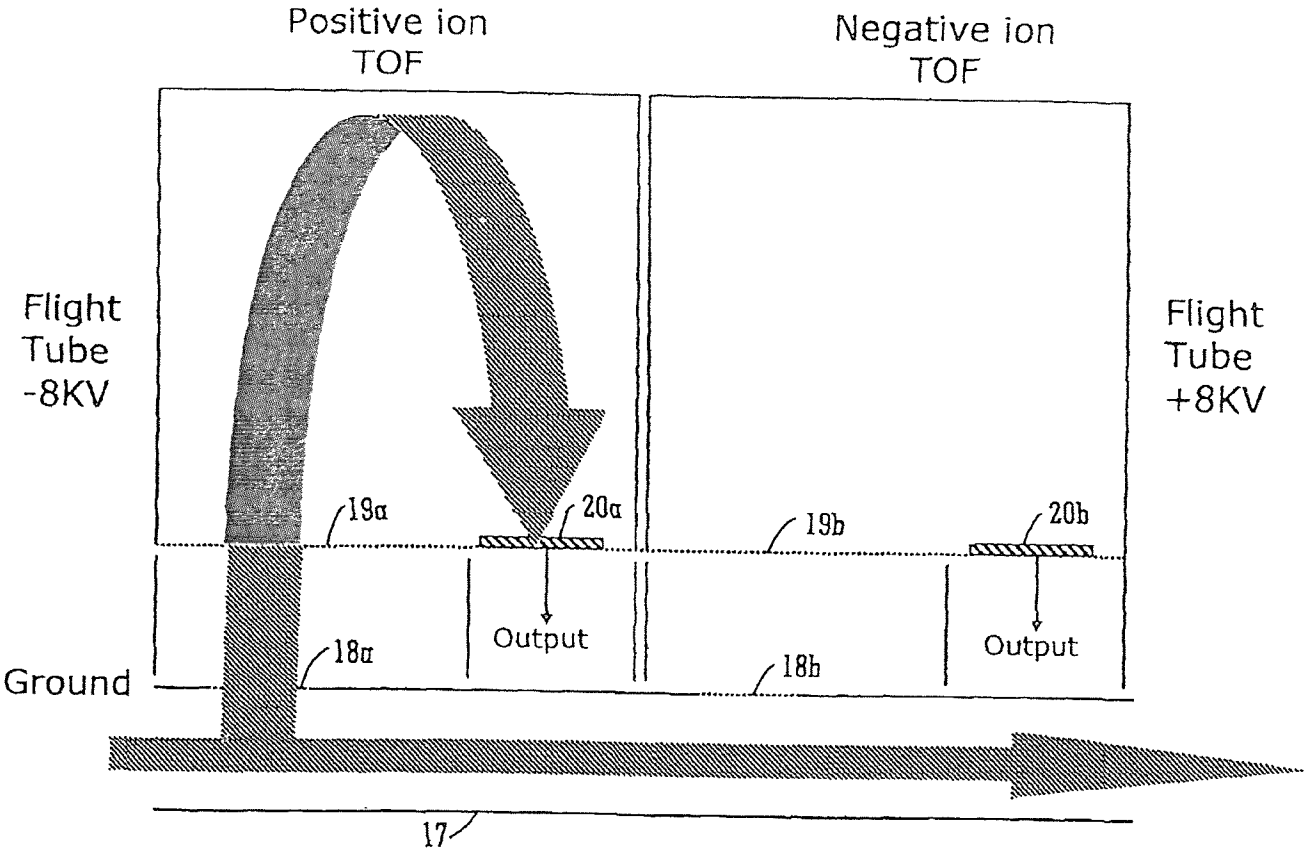
FIG. 12 shows a further embodiment of the present invention comprising two adjacent Time of Flight mass analysers each comprising a reflectron.

FIG. 12 shows a further embodiment relating to a mass spectrometer comprising two orthogonal acceleration Time of Flight mass analysers each having a reflectron. In this embodiment ions arrive in the pusher region or orthogonal acceleration extraction region arranged between a pusher electrode 17 and first grid electrodes 18*a*,18*b*. When the instrument is set to detect positive ions then ions are orthogonally accelerated into the first Time of Flight mass analyser comprising a first grid electrode 18*a*, a second grid electrode 19*a*, a field free region, reflectron and an ion detector 20*a*. The first grid electrode 18*a* is preferably held at ground or 0V and the flight tube is preferably held at −8 kV. A voltage pulse having an amplitude of +2 kV is preferably applied to the pusher electrode 17. The second Time of Flight mass analyser comprises a first grid electrode 18*b*, a second grid electrode 19*b*, a field free region, a reflectron and an ion detector 20*b*. The first grid electrode 18*b* is preferably held at ground or 0V and the flight tube is preferably held at +8 kV. As a result, (positive) ions are preferably only orthogonally accelerated into the first Time of Flight mass analyser and detected by the ion detector 20*a*.

In an alternative (unillustrated) embodiment, ions arrive in the pusher region or orthogonal acceleration extraction region arranged between the pusher electrode 17 and first grid electrodes 18*a*,18*b*. When the instrument is set to analyse negative ions then ions are orthogonally accelerated into the second Time of Flight mass analyser. The first grid electrode 18*b* is preferably held at ground or 0V and the flight tube is preferably held at +8 kV. A voltage pulse having an amplitude of −2 kV is preferably applied to the pusher electrode 17. As a result, (negative) ions are preferably only orthogonally accelerated into the second Time of Flight mass analyser and detected by the ion detector 20*b*.

According to an embodiment the two orthogonal acceleration Time of Flight mass analysers each preferably comprising a reflectron may share the same extended pusher electrode 17 and first grid plates or electrodes 18*a*,18*b*. Ions may be directed into one or the other analyser by choosing the polarity of the pusher pulse.

Although the present invention has been described with reference to the preferred embodiments, it will be understood by those skilled in the art that various changes in form and detail may be made without departing from the scope of the invention as set forth in the accompanying claims.

The invention claimed is:

1. A mass spectrometer comprising:

a Time of Flight mass analyzer comprising an orthogonal acceleration extraction region;

said mass spectrometer further comprising an ion beam expander arranged and adapted to expand an ion beam so that said ion beam has a diameter or a cross-sectional width>6 mm in said orthogonal acceleration extraction region.

2. A mass spectrometer as claimed in claim 1, wherein said ion beam expander is arranged and adapted to expand said ion beam so that said ion beam has a diameter or a cross-sectional width>7 mm, >8 mm, >9 mm or >10 mm in said orthogonal acceleration extraction region.

3. A mass spectrometer as claimed in claim 1, wherein said ion beam expander is arranged and adapted to expand said ion beam so that said ion beam has a diameter or a cross-sectional width of x mm in said orthogonal acceleration extraction region, wherein x is selected from the group consisting of: (i) 6-7; (ii) 7-8; (iii) 8-9; (iv) 9-10; (v) 10-11; (vi) 11-12; (vii) 12-13; (viii) 13-14; (ix) 14-15; (x) 15-16; (xi) 16-17; (xii) 17-18; (xiii) 18-19; (xiv) 19-20; (xv) 20-21; (xvi) 21-22; (xvii) 22-23; (xviii) 23-24; (xix) 24-25; (xx) 25-26; (xxi) 26-27; (xxii) 27-28; (xxiii) 28-29; (xxiv) 29-30; (xxv) 30-31; (xxvi) 31-32; (xxvii) 32-33; (xxviii) 33-34; (xxix) 34-35; (xxx) 35-36; (xxxi) 36-37; (xxxii) 37-38; (xxxiii) 38-39; (xxxiv) 39-40; and (xxxv) >40.

4. A mass spectrometer as claimed in claim 1, wherein said Time of Flight mass analyzer is arranged downstream of an RF ion confinement device, and wherein said ion beam expander is arranged downstream of said RF ion confinement device, said ion beam expander being arranged and adapted to expand the ion beam which emerges, in use, from said RF ion confinement device.

5. A mass spectrometer as claimed in claim 4, wherein said RF ion confinement device comprises an ion guide or ion trap.

6. A mass spectrometer as claimed in claim 4, wherein said mass spectrometer further comprises a first vacuum chamber, a second vacuum chamber and a differential pumping aperture arranged between said first vacuum chamber and said second vacuum chamber, wherein said RF ion confinement device is located in said first vacuum chamber and said Time of Flight mass analyzer is arranged in said second vacuum chamber.

7. A mass spectrometer as claimed in claim 6, wherein said ion beam expander comprises a first Einzel lens arranged in said first vacuum chamber and a second Einzel lens arranged in said second vacuum chamber.

8. A mass spectrometer as claimed in claim 4, wherein the distance L between an ion exit of said RF confinement device and the longitudinal mid-point of said orthogonal acceleration extraction region is selected from the group consisting of: (i) >100 mm; (ii) 100-120 mm; (iii) 120-140 mm; (iv) 140-160 mm; (v) 160-180 mm; (vi) 180-200 mm; (vii) 200-220 mm; (viii) 220-240 mm; (ix) 240-260 mm; (x) 260-280 mm; (xi) 280-300 mm; (xii) 300-320 mm; (xiii) 320-340 mm; (xiv) 340-360 mm; (xv) 360-380 mm; (xvi) 380-400 mm; and (xvii) >400 mm.

9. A mass spectrometer as claimed in claim 4, wherein said ion beam which emerges, in use, from said RF ion confinement device has a first cross section, a first positional spread and a first velocity spread and wherein said ion beam in said orthogonal acceleration extraction region has a second cross section, a second positional spread and a second velocity spread, and wherein:

(i) said second positional spread is greater than said first positional spread; or (ii) said second velocity spread at a particular position is less than said first velocity spread at a particular position; or (iii) a maximum diameter or maximum cross-sectional width of said first cross section is less than a maximum diameter or maximum cross-sectional width of said second cross section.

10. A mass spectrometer as claimed in claim 1, wherein said Time of Flight mass analyzer comprises a pusher electrode and a first grid electrode, wherein said orthogonal acceleration extraction region is arranged between said pusher electrode and said first grid electrode, and wherein in use at least some ions located in said orthogonal acceleration extraction region are orthogonally accelerated into a drift region of said Time of Flight mass analyzer.

11. A mass spectrometer as claimed in claim 10, wherein said Time of Flight mass analyzer further comprises a second grid electrode arranged downstream of said first grid electrode, a field free region arranged downstream of said second grid electrode and upstream of an ion detector.

12. A mass spectrometer as claimed in claim 11, wherein said Time of Flight mass analyzer is arranged so that ions pass from said first grid electrode to said second grid electrode, through said field free region to said ion detector without being reflected in the opposite direction.

13. A mass spectrometer as claimed in claim 1, wherein said Time of Flight mass analyzer comprises a reflectron.

14. A mass spectrometer as claimed in claim 1, wherein said Time of Flight mass analyzer is arranged and adapted to analyze positive ions and said mass spectrometer further comprises a further Time of Flight mass analyzer arranged and adapted to analyze negative ions, wherein said further Time of Flight mass analyzer is arranged adjacent to said Time of Flight mass analyzer.

15. A mass spectrometer as claimed in claim 1, wherein said ion beam expander comprises one or more Einzel lenses or other ion-optical devices.

16. A method of mass spectrometry comprising:

providing a Time of Flight mass analyzer comprising an orthogonal acceleration extraction region; and expanding an ion beam using an ion beam expander so that said ion beam has a diameter or a cross-sectional width>6 mm in said orthogonal acceleration extraction region.

17. A method of mass spectrometry as claimed in claim 16, further comprising providing an RF ion confinement device and arranging said Time of Flight mass analyzer downstream of said RF ion confinement device, so that the ion beam which emerges from said RF ion confinement device is expanded.

* * * * *